US005174742A

United States Patent [19]

Putney

[11] Patent Number: 5,174,742

[45] Date of Patent: Dec. 29, 1992

[54] ROTARY AIR MOTOR WITH CURVED TANGENTIAL VANES

[75] Inventor: Gordon A. Putney, Lake Geneva, Wis.

[73] Assignee: Snap-on Tools Corporation, Kenosha, Wis.

[21] Appl. No.: 829,409

[22] Filed: Feb. 3, 1992

[51] Int. Cl.[5] ..... F01C 1/344; F01C 19/00

[52] U.S. Cl. ..... 418/152; 418/237

[58] Field of Search ..... 418/237, 239, 254, 179, 418/152, 236, 238

[56] References Cited

U.S. PATENT DOCUMENTS

| | | | |
|---|---|---|---|
| 129,953 | 7/1872 | Hawley et al. | 418/237 |
| 410,747 | 10/1889 | Young | 418/237 |
| 1,831,243 | 11/1931 | Hart et al. | 418/237 |
| 1,968,537 | 7/1934 | Plato | 418/237 |
| 2,492,868 | 12/1949 | Johnson | 418/237 |
| 2,555,679 | 6/1951 | Cornwell | 418/237 |
| 3,989,427 | 11/1976 | Meyer | 418/237 |
| 4,225,293 | 9/1980 | Lee | 418/237 |

FOREIGN PATENT DOCUMENTS

| | | | |
|---|---|---|---|
| 315582 | 11/1971 | U.S.S.R. | 418/237 |
| 10934 | of 1892 | United Kingdom | 418/237 |

*Primary Examiner*—John J. Vrablik
*Attorney, Agent, or Firm*—Emrich & Dithmar

[57] ABSTRACT

A rotary air motor has a stator with a cylindrical inner surface defining a chamber and a cylindrical rotor mounted by hub structure for eccentric rotation within the chamber and end plates closing the opposite ends of the chamber and spaced from the adjacent ends of the rotor by end clearance spaces. The rotor has a plurality of arcuate slots therein extending the length thereof and respectively slidably receiving arcuate vanes arranged so that when the rotor is rotated the outermost edges of the vanes are centrifugally urged into sliding engagement with the inner surface of the stator. The hub structure includes a cylindrical shaft extending coaxially through the rotor and hub members having cylindrical outer surfaces intersecting each of the slots, with the vanes being so dimensioned that each vane tangentially engages the cylindrical outer surfaces of the hub members along substantially the entire axial extend of the end clearance spaces in all positions of the vane, thereby to provide an effective seal between the vanes and the hub structure. The end clearance spaces may be substantially greater than the clearance between the end plates and the adjacent axially spaced ends of the vanes.

20 Claims, 3 Drawing Sheets

Fig 8
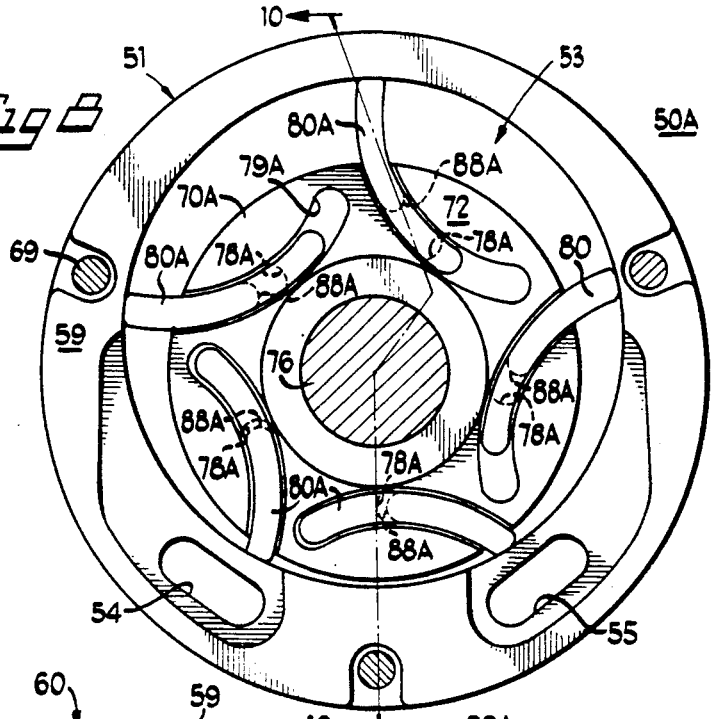
Fig 10
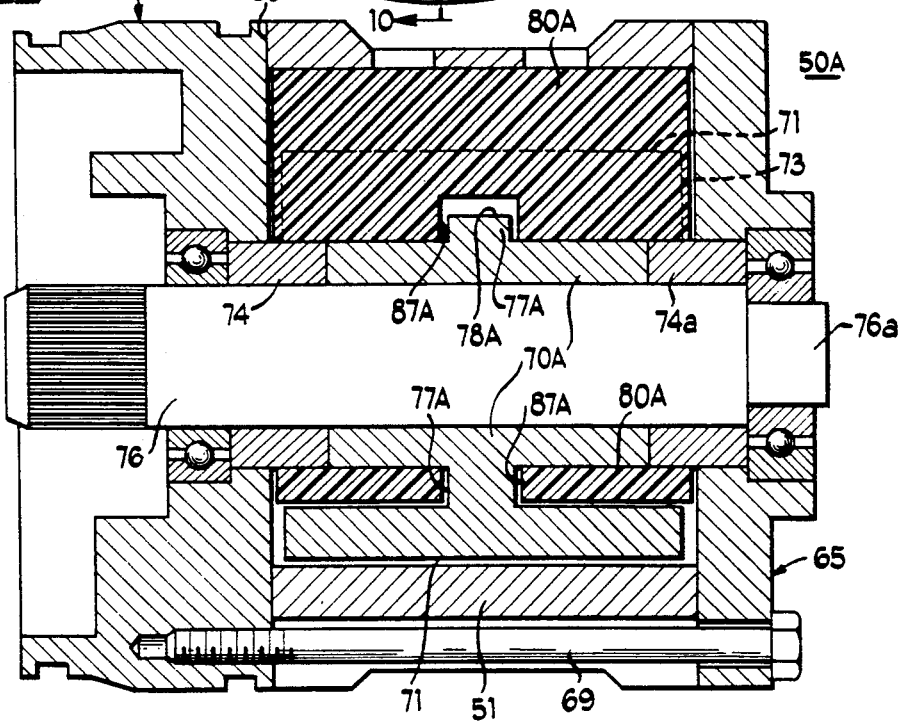
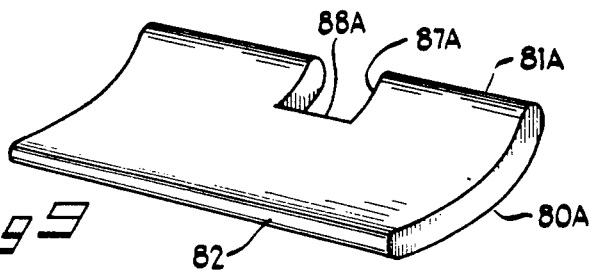
Fig 9

ROTARY AIR MOTOR WITH CURVED TANGENTIAL VANES

BACKGROUND OF THE INVENTION

1. Field of the Invention

The present invention relates to rotary fluid handling devices and, in particular, rotary air motors of the type having a rotor rotating in a chamber with vanes slidably mounted in the rotor so that the ends of the vanes constantly engage the walls of the chamber as the rotor rotates.

2. Description of the Prior Art

Current air motors typically have a rotor which rotates within a stator chamber. The rotor has slots in which vanes are slidably disposed. The rotor may have either radially arranged vanes ("RAV") or tangentially arranged vanes ("TAV"). In either type, the motor typically has a pair of end plates which respectively close the opposite ends of the stator chamber and which are respectively spaced a clearance distance from the adjacent ends of the rotor and the vanes to accommodate free rotation thereof.

In the RAV type motor, the vanes are in the form of substantially flat plates which are respectively slidably received in radial slots in the rotor for sliding radial movement between innermost and outermost positions. Typically, the vane slots extend into the rotor shaft or hub and the vanes have a radial extent substantially equal to that of the slots. As the rotor rotates, the vanes are urged radially outwardly by centrifugal force into sliding engagement with the inner surface of the stator. Typically, the rotor is mounted eccentrically with respect to the stator chamber so that as it rotates the vanes move radially in and out between their innermost and outermost positions during each rotation.

The TAV type air motor is substantially the same as the RAV type motor, except that the vanes are respectively disposed in slots which are arranged substantially tangentially with respect to the rotor shaft rather than radially.

RAV type motors are characterized in that: (1) the motor may be bi-directional, i.e., since the vanes engage the stator chamber wall substantially radially, they exhibit substantially the same drag in either direction of rotation; (2) a larger number of vanes can be accommodated in the motor and (3) full sealing effectiveness is achieved against the inner wall of the stator because of the centrifugal forces on the vanes. The TAV type air motor is characterized by: (1) a greater vane length which permits increased wear life; (2) the accommodation of a through shaft for the rotor, since the vanes do not extend inwardly of the shaft circumference; (3) unidirectionality, since the vanes will tend to jam against the wall of the stator if the rotor is rotated in the same direction that the vanes exit the rotor; and (4) a performance drop because the vanes engage the stator chamber along a line which is inclined with respect to the direction of the centrifugal forces, thereby reducing the sealing effect.

In both the RAV and TAV motors, when the vanes are in their outermost positions, their inner ends are typically spaced radially outwardly from the hub or shaft of the rotor, creating a leakage gap in the region between the end plates and the end faces of the rotor. This leakage could be alleviated in the case of the TAV air motor if the vanes and slots are sufficiently long that the vane will remain tangent to the rotor shaft in all positions of the vane, but this reduces the number of vanes which can be accommodated in a rotor.

Accordingly, in prior air motors it is typically necessary to provide for a minimal clearance between the end plates and the adjacent ends of the rotor in order to avoid excessive leakage between the compartments formed by adjacent vanes. This necessitates the use of expensive precision parts made to very close tolerances.

Referring to FIGS. 1 and 2, there is illustrated a prior art air motor 10 which includes a stator 11 having a cylindrical inner surface 12 defining a cylindrical chamber 13. A cylindrical rotor 15 is rotatably mounted in the chamber 13 on hub structure 16 which includes a shaft 17 extending axially of the rotor 15, the hub structure 16 having an outer surface 18. Formed in the rotor 15 are four equiangularly spaced apart radial slots 19, each extending from the outer surface of the rotor 15 radially into the shaft 17. Four vanes 20 are respectively slidably disposed in the slots 19. Each of the vanes 20 is in the form of a flat plate extending the length of the rotor 15 and having a width substantially equal to the depth of the slots 19. Each of the vanes 20 has radially spaced outer and inner edges 21 and 22 and a pair of axially spaced end edges 23 (one shown in FIG. 2). In operation, as the rotor 15 rotates, the vanes 20 are urged by centrifugal force radially outwardly to hold the radially outer edges 21 thereof in sliding engagement with the inner surface 12 of the stator 11 for cooperation therewith and with the outer surface of the rotor 15 to divide the chamber 13 into four compartments 24.

The air motor 10 also includes a pair of end plates 25 (one shown), each having an inner surface 26 which bears against the associated end face of the stator 11 and is spaced a small clearance distance from the adjacent end edges 23 of the vanes 20 and the adjacent end face 27 of the rotor 15 so as to provide a running clearance. For purposes of illustration, the clearance gap between the end plate 25 and the vanes 20 is illustrated as being a very slight gap, while the clearance gap between the end plate 25 and the rotor 15 is more substantial, and greatly exaggerated. The difference is intended to be the difference between a very close tolerance, e.g., a few thousandths of an inch and a loose tolerance, e.g., a few tens of thousandths of an inch. The clearance between the end plate 25 and the vanes 20 may be substantially the same as that between the end plate 25 and the rotor 15, but is shown as being different for purposes of illustration.

As can be seen, when the vanes 20 are in their outermost positions (the bottom vane as seen in FIGS. 1 and 2), the inner edge 22 of the vane is spaced radially outwardly beyond the outer surface 18 of the hub structure 16, creating a leakage gap 28 therebetween which permits leakage of air between the adjacent compartments 24 at the ends of the rotor 15. If the parts are made to loose tolerances, this leakage is substantial and seriously impairs the efficiency of the motor. Accordingly, prior art air motors have had to maintain the end clearance gap between the end plate and the adjacent ends of the vanes and rotor as small as possible, necessitating the manufacture of the parts to very close tolerances, at considerable expense.

In FIG. 3, there is illustrated another prior art air motor 30 which is similar to the air motor 10, except that it has tangential, rather than radial vanes. More specifically, the air motor 30 includes a rotor 35 which is rotatably mounted on hub structure 36 including an elongated shaft 37, the hub structure 36 having an outer surface 38. Formed in the rotor 35 are four equiangularly spaced apart slots 39, each extending tangent to the outer surface 38 of the hub structure 36 and having the inner end thereof terminating substantially at a diameter of the hub structure 36. Vanes 40 are respectively disposed in the slots 39 and have a width substantially equal to the depth of the slots 39, each of the vanes 40 having radially spaced outer and inner edges 41 and 42. The outer edge 41 is angled or curved to substantially match the curvature of the inner surface 12 of the stator so as to provide an effective seal, necessitating unidirectional operation. The vanes 40 serve to divide the chamber into four compartments 44.

As can be seen in FIG. 3, when the vanes 40 are in their innermost or fully retracted positions, they are tangent to the outer surface 38 of the hub structure 36 so as to provide a seal thereat between the adjacent compartments 44. However, when the vanes 40 are moved outwardly away from their fully retracted positions, a leakage gap 48 will be opened between the end plates and the adjacent ends of the rotor 35, in substantially the same manner as was described above in connection with FIGS. 1 and 2.

SUMMARY OF THE INVENTION

It is a general object of the invention to provide an improved rotary air motor which avoids the disadvantages of prior air motors while affording additional structural and operating advantages.

An important feature of the invention is the provision of a rotary fluid handling device of the type with centrifugally slidable vanes which minimizes leakage between the compartments formed by adjacent vanes.

In connection with the foregoing feature, it is another feature of the invention to provide a rotary fluid handling device of the type set forth, which is bi-directional.

Still another feature of the invention is the provision of a rotary fluid handling device of the type set forth, which has a rotor which accommodates a through shaft while at the same time maximizing the number of vanes.

Still another feature of the invention is the provision of a rotary fluid handling device of the type set forth, which permits the use of parts made to relatively loose tolerances while at the same time maintaining acceptable performance.

These and other features of the invention are attained by providing in a rotary fluid handling device including a stator having a cylindrical inner surface defining a cylindrical chamber, a cylindrical rotor mounted by hub structure for rotation within the chamber, and end plates respectively disposed for closing the opposite ends of the chamber and respectively spaced by rotor end clearance spaces from the adjacent ends of the rotor, the rotor having a plurality of slots therein extending the length thereof and respectively slidably receiving a plurality of vanes dimensioned so that when the rotor is rotated the outermost edges of the vanes are centrifugally urged into sliding engagement with the inner surface of the stator, the improvement comprising: the hub structure including cylindrical surface means intersecting each of the slots at the opposite ends of the rotor, each of the slots and the vanes being so dimensioned that each vane tangentially engages the cylindrical surface means in the end clearance spaces in all positions of the vanes thereby to provide an effective seal between the vanes and the hub structure.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 8 is a reduced view, similar to FIG. 5, illustrating an alternative form of rotor and vane arrangement;

FIG. 9 is a view, similar to FIG. 6, showing an alternative vane of FIG. 8; and FIG. 10 is a reduced view, similar to FIG. 7, taken generally along the line 10—10 in FIG. 8.

DESCRIPTION OF THE PREFERRED EMBODIMENTS

Figure 1:
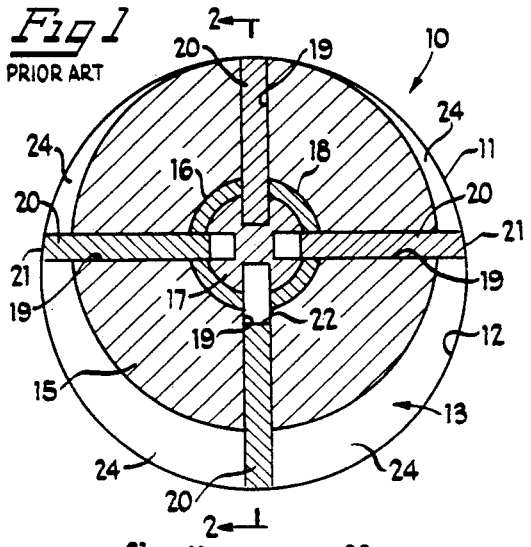
Fig 1 PRIOR ART
FIG. 1 is a sectional view perpendicular to the axis of a prior art air motor having radial vanes.
Figure 3:
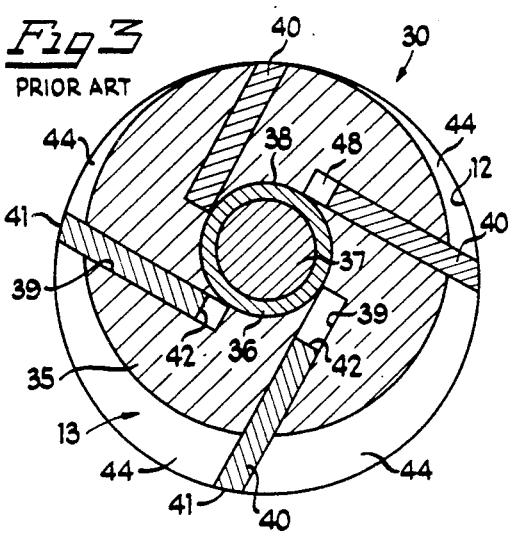
Fig 3 PRIOR ART
FIG. 3 is a view similar to FIG. 1 of a prior art air motor having tangential vanes.
Figure 2:
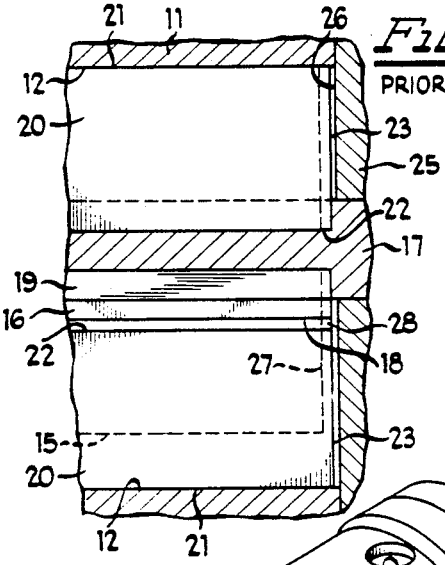
Fig 2 PRIOR ART
FIG. 2 is a fragmentary sectional view taken along the line 2—2 in FIG. 1, with certain dimensions exaggerated to illustrate a disadvantageous leakage path.
Figure 6:
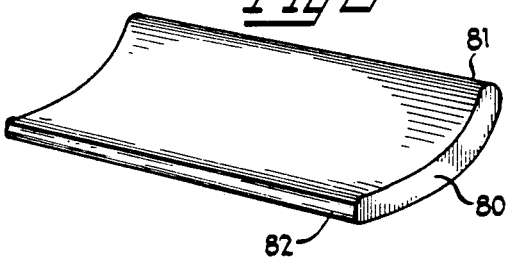
FIG. 6 is a reduced perspective view of one of the vanes of the air motor illustrated in FIG. 5.
Figure 4:
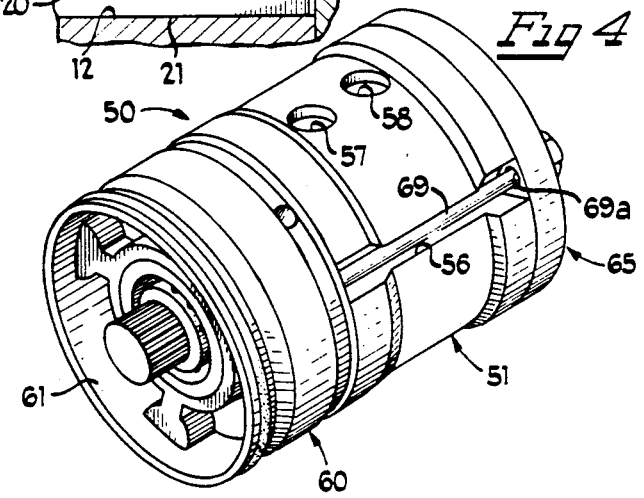
FIG. 4 is a perspective view of an air motor constructed in accordance with and embodying the features of the present invention.

Referring now to FIGS. 4–7, there is illustrated an air motor 50, constructed in accordance with and embodying the features of the present invention. The air motor 50 includes a stator 51 which is generally cylindrical in shape and has an eccentric cylindrical inner surface 52 which defines a cylindrical chamber 53. The stator 51 is provided with a pair of passages 54 and 55 extending longitudinally therethrough outside the chamber 53. Formed in the outer surface of the stator 51 are three equiangularly spaced apart grooves 56. Extending radially through the wall of the stator 51 intermediate the ends thereof and into the chamber 53 are two longitudinally spaced-apart ports 57 and 58. The stator 51 has parallel end faces 59, in each of which is formed a pair of recesses **59*a* respectively around the adjacent ends of the passages 54 and 55 (shown in one face in FIG. 5**).

The air motor 50 also includes a circular end plate 60 which has an axially outwardly extending cylindrical flange 61 and is provided with a planar inner face 62 which abuts the adjacent end face 59 of the stator 51. The end plate 60 has an axial bore 63 therethrough and carries a ball bearing assembly 64 coaxially with the bore 63. The air motor 50 also includes an end plate 65 which closes the chamber 53 at the other end thereof, the end plate 65 having a planar inner end face 66 which abuts the adjacent end face 59 of the stator 51. The end plate 65 has an axial bore 67 therethrough and also carries a ball bearing assembly 68 coaxially with the bore 67. The end plates 60 and 65 are respectively fixedly secured to the stator 51 by screws 69 which respectively extend through complementary holes 69*a* in the end plate 65 (one shown in FIGS. 4 and 7) and through the grooves 56 in the stator 51 and are threadedly engaged in bores 69*b* in the end plate 60 (one shown in FIG. 7).

The air motor 50 also includes a cylindrical rotor 70 which has an outer cylindrical surface 71 and parallel, planar, annular end faces 72 and 73 at the opposite ends thereof spaced apart a distance very slightly less than the length of the stator 51. The end faces 72 and 73 are respectively provided with annular recesses 72*a* and 73*a* therein at the inner portions thereof.

The rotor 70 is provided with a pair of cylindrical hubs 74 and 74*a*, respectively received in the recesses 72*a* and 73*a* and projecting axially outwardly a predetermined distance beyond the end faces 72 and 73 and respectively having cylindrical outer surfaces 75 and 75*a*. The outer ends of the hubs 74 and 74*a* are respectively received in the bores 63 and 67 in the end plates 60 and 65. It will be appreciated that, alternatively, a through hub could be provided. An elongated shaft 76 extends axially through the rotor 70 and the hubs 74 and 74*a* and is fixed to each. The shaft 76 has one end thereof journalled in the bearing 64 and is provided at the other end thereof with a reduced-diameter portion 76*a* which is journalled in the bearing 68. The shaft 76 is preferably formed of a high-strength material, such as steel. While the hubs 74 and 74*a* are illustrated as being discrete from the shaft 76, it will be appreciated that they could be formed unitary with the shaft 76. Alternatively, the hubs 74 and 74*a* could be insert molded on the rotor 70 and/or on the shaft 76. In such cases, the rotor 70 and the hubs 74 and 74*a* would be preferably formed of a moldable plastic material, such as a polymer composite material.

Formed in the rotor 70 are five equiangularly spaced-apart arcuate slots 79, each substantially part-cylindrical in shape and each extending longitudinally the entire length of the rotor 70 and being tangent along its entire length to the outer surface 75 of the hub 74. Respectively disposed in the slots 79 are arcuate vanes 80, each substantially identical in construction and dimensioned for sliding movement within the slots 79 between retracted and extended positions. The width of each of the vanes 80 along its arc is substantially the same as the depth of the associated slot 79 along its arc inner end 81 and a flattened outer end 82 and axially spaced end surfaces 83. The slots 79 and the vanes 80 are so dimensioned and arranged that in all positions of the rotor 70, the outer ends 82 of the vanes will engage the inner surface 52 of the stator 51 substantially along a radial plane of the rotor 70 which passes through the center of the mouth of the associated slot 79. This permits operation of the air motor 50 in either direction without binding of the vanes 80 against the stator 51.

In use, it will be appreciated that the vanes 80 are, in a well-known manner, provided with a suitable assist to initially move them to their outermost positions in engagement with the inner surface 52 of the stator 51 for cooperation therewith and with the rotor 70 for dividing the chamber 53 into a plurality of compartments 84. Air enters the air motor 50 at the right-hand end (as viewed in FIG. 7) of the passage 55 through a complementary opening (not shown) in the end plate 65. It passes through the length of the passage 55 and into the recesses 59*a* at the other end of the stator 51 and thence into the adjacent ones of the compartments 84 of the chamber 53, as indicated by the arrow 90 in FIG. 5. The ports 57 and 58 are vented to atmosphere and constitute the primary exhaust openings. Thus, a pressure differential is created in the compartment or compartments 84 exposed to the incoming air, which bears against the downstream vanes 80 and tends to rotate the rotor 70 in a counterclockwise direction, as viewed in FIG. 5. As the rotor 70 is rotated, the vanes 80 are driven outwardly by centrifugal force so as to be held in their outermost positions in sliding engagement with the inner surface 52 of the stator 51. As the compartment 84 passes the ports 57 and 58, most of the air therein is exhausted. However, some air will remain in the compartment 84 and, as it continues to move past the primary exhaust ports 57 and 58, the compartment 84 becomes smaller tending to compress the residual air therein. In order to avoid any adverse effect from this compressed air, it is vented to atmosphere through the other recess 59*a* and the passage 54. In order to operate the air motor 50 in the opposite direction, the passage 54 becomes the inlet and the passage 55 becomes the secondary exhaust channel.

Figure 5:
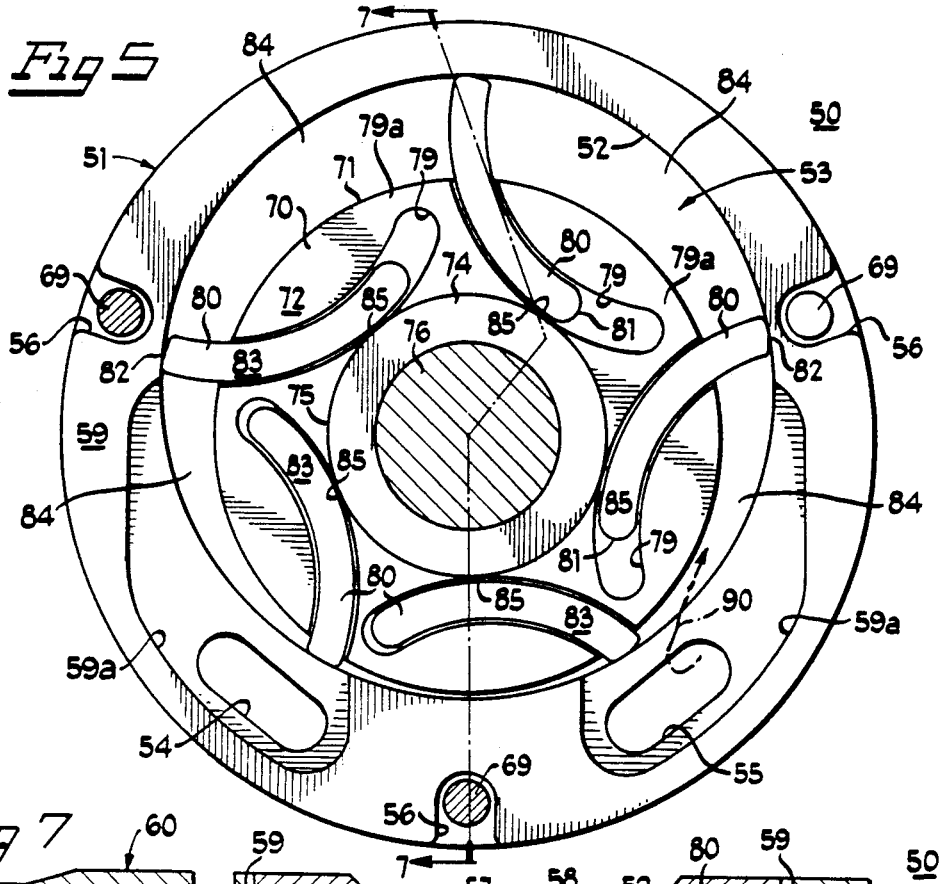
FIG. 5 is an enlarged, end elevational view in partial section of the air motor of FIG. 4 with the associated end plate removed.
Figure 7:
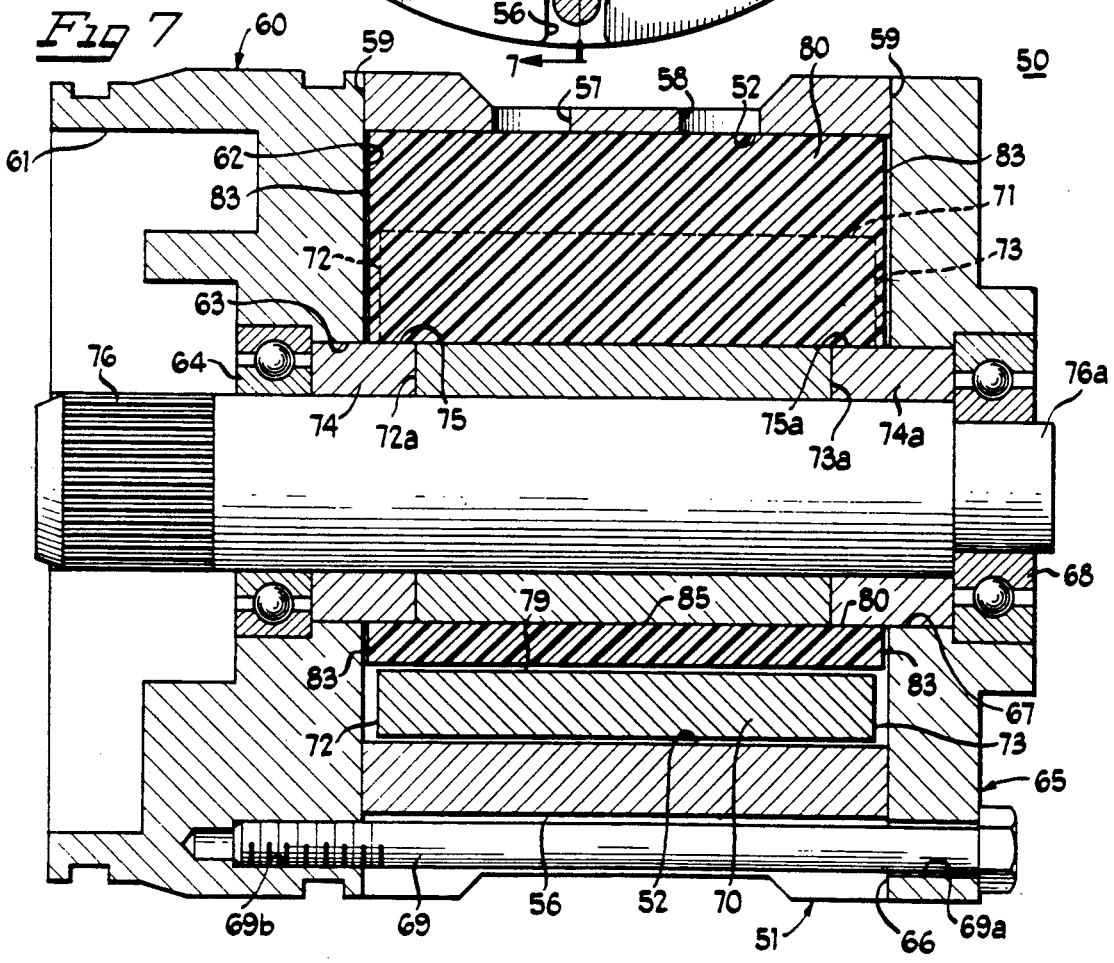
FIG. 7 is a sectional view in taken generally along the line 7—7 in FIG. 5, with the top half of the view foreshortened.

It is a significant aspect of the present invention that the curvature and lengths of the slots 79 and the vanes 80 are such that, in all positions of the vanes 80 they remain in tangent engagement with the outer surfaces 75 and 75*a* of the hubs 74 and 74*a* along tangency lines 85 (FIGS. 5 and 7). Thus, even if the end clearance gap between the end faces 83 of the rotor 70 and the inner faces 62 and 66 of the end plates 60 and 65 is substantial, there will be no substantial leakage path between adjacent compartments 84 because the vanes 80 will seal against the outer surfaces 75 and 75*a* of the hubs 74 and 74*a*. In this regard, it will be appreciated that the length of the vanes 80 may be slightly greater than the length of the rotor 70 so that sealing against the hub 74 will be effected in the end clearance regions between the end plates 60 and 65 and the adjacent ends of the rotor 70.

Depending upon the number of vanes 80, the formation of the vanes slots 79 in the rotor 70 may leave very narrow neck regions 79*a* (see FIG. 5). These neck regions 79*a* might tend to act as hinge locations and permit slight deflection of the portions of the rotor 70 immediately outboard of the slots 79 during rotation of the rotor 70. Such deflection may be prevented by the use of an alternative arrangement embodied in an air motor 50A illustrated in FIGS. 8–10. This arrangement utilizes an alternative construction of rotor and vanes, but the air motor 50A is in all other respects identical to the air motor 50 of FIGS. 4–7, so like parts will bear the same reference numbers, with altered parts designated by the suffix "A". In the motor 50A each of the vanes slots 79A of the rotor 70A is provided, midway along its axial length, with a rib 77A which extends from the closed end of the slot 79A approximately one-third of the distance to the open end thereof, spanning the entire width of the slot 79A, the rib 77A being provided with an end surface 78A. The ribs 77A serve as stiffening members to prevent outward deflection of hinged portions of the rotor 70A. Each of the vanes 80A has a slot 87A formed in the rounded inner end 81A thereof midway along the length thereof, positioned and dimensioned to accommodate the associated rib 77A, and having an end surface 88A. It will be appreciated that the depth of the slots 87A is the same as the length of the ribs 77A, so that the vanes 80A can freely move to their innermost positions, with their inner ends 81A bottomed in the slots 79A.

In a constructional model of the invention, the vanes 80 and 80A may be formed of a suitable plastic material and, therefore, may be made to close tolerances less expensively than the metal stator 51 and the end plates 60 and 65. In any event, it has been found that the end clearance between the end plates and the ends of the vanes in an air motor has less of an effect on efficiency than does the end clearance between the end plates and the rotor.

From the foregoing, it can be seen that there has been provided an improved rotary air motor which minimizes leakage between chamber compartments while at the same time permitting the use of parts made to relatively loose tolerances.

I claim:

1. In a rotary fluid handling device including a stator having a cylindrical inner surface defining a cylindrical chamber, a cylindrical rotor mounted by hub structure for rotation within the chamber, and end plates respectively disposed for closing the opposite ends of the chamber and respectively spaced by rotor end clearance spaces from the adjacent ends of the rotor, the rotor having a plurality of slots therein extending the length thereof and respectively slidably receiving a plurality of vanes dimensioned so that when the rotor is rotated the outermost edges of the vanes are centrifugally urged into sliding engagement with the inner surface of the stator, the improvement comprising: the hub structure including cylindrical surface portions respectively disposed adjacent to the opposite ends of the rotor, each of said surface portions intersecting each of the slots at the adjacent end of the rotor, each of the slots and the vanes being so dimensioned that each vane tangentially engages said cylindrical surface portions in the end clearance spaces in all positions of the vanes thereby to provide an effective seal between the vanes and the hub structure.

2. The device of claim 1, wherein each of the vanes is formed of a plastic material.

3. The device of claim 1, wherein the device includes at least four vanes.

4. The device of claim 3, wherein the device includes five vanes.

5. The device of claim 1, wherein each of the slots and each of the vanes is curved in a substantially part-cylindrical shape having an axis substantially parallel to the axis of the hub structure.

6. The device of claim 5, each of the slots and the vanes is so configured that the outermost edges of the vanes bear against the inner surface of the stator in a substantially radial direction.

7. The device of claim 1, wherein the vanes and the slots are configured for accommodating bi-directional rotation of the rotor within the stator.

8. The device of claim 1, wherein the rotor end clearance spaces are substantially greater than the clearance between the axially spaced ends of the vanes and the end plates.

9. The device of claim 1, wherein said device is an air motor.

10. The device of claim 1, wherein the rotor is disposed eccentrically with respect to the stator chamber.

11. In a rotary fluid handling device including a stator having a cylindrical inner surface defining a cylindrical chamber, a cylindrical rotor mounted by hub structure for rotation within the chamber, and end plates respectively disposed for closing the opposite ends of the chamber and respectively spaced by rotor end clearance spaces from the adjacent ends of the rotor, the rotor having a plurality of slots therein extending the length thereof and respectively slidably receiving a plurality of vanes dimensioned so that when the rotor is rotated the outermost edges of the vanes are centrifugally urged into sliding engagement with the inner surface of the stator, the improvement comprising: the hub structure including a cylindrical shaft extending coaxially through the rotor and through the end plates and a pair of hub members fixed on said shaft and respectively spanning the end clearance spaces at the opposite ends of the rotor, each of said hub members having a cylindrical outer surface intersecting each of the slots along said end clearance spaces, each of the slots and the vanes being so dimensioned that each vane tangentially engages said cylindrical outer surface of said shaft along substantially the entire axial extent of the end clearance spaces in all positions of the vanes thereby to provide an effective seal between the vanes and said hub structure.

12. The device of claim 11, wherein each of the vanes is formed of a plastic material.

13. The device of claim 11, wherein each of the slots has a stiffening rib therein interemediate the axially spaced ends thereof and each of the vanes has an opening therein to accommodate said rib.

14. The device of claim 13, wherein the device includes five vanes.

15. The device of claim 11, wherein each of the slots and each of the vanes is curved in a substantially part-cylindrical shape having an axis substantially parallel to the axis of said shaft.

16. The device of claim 15, each of the slots and the vanes is so configured so that the outermost edges of the vanes bear against the inner surface of the stator in a substantially radial direction.

17. The device of claim 11, wherein the vanes and the slots are configured for accommodating bi-directional rotation of the rotor within the stator.

18. The device of claim 11, wherein the rotor end clearance spaces are substantially greater than the clearance between the axially spaced ends of the vanes and the end plates.

19. The device of claim 11, wherein said device is an air motor.

20. The device of claim 11, wherein the rotor is disposed eccentrically with respect to the stator chamber.

* * * * *